US007559448B2

(12) United States Patent
Kanai et al.

(10) Patent No.: US 7,559,448 B2
(45) Date of Patent: Jul. 14, 2009

(54) STAPLE FORMING AND DRIVING MACHINE

(75) Inventors: Toshiyuki Kanai, Tokyo (JP); Nobuaki Yagi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/569,793

(22) PCT Filed: Sep. 10, 2004

(86) PCT No.: PCT/JP2004/013599

§ 371 (c)(1),
(2), (4) Date: Feb. 27, 2006

(87) PCT Pub. No.: WO2005/025810

PCT Pub. Date: Mar. 24, 2005

(65) Prior Publication Data

US 2006/0273133 A1 Dec. 7, 2006

(30) Foreign Application Priority Data

Sep. 10, 2003 (JP) ..... 2003-318944

(51) Int. Cl.
*B25C 5/04* (2006.01)

(52) U.S. Cl. ..... 227/120; 227/154; 227/155; 227/82; 227/85; 227/86; 227/87; 227/89

(58) Field of Classification Search ..... 227/120, 227/154, 155, 82, 85–87, 89
See application file for complete search history.

(56) References Cited

U.S. PATENT DOCUMENTS

| | | | | |
|---|---|---|---|---|
| 2,537,480 | A | 1/1951 | Nasmith et al. | 1/2 |
| 2,716,749 | A | 9/1955 | Timmerbeil | 1/49 |
| 4,318,555 | A | 3/1982 | Adamski et al. | 283/7 |
| 4,570,841 | A * | 2/1986 | Olesen | 227/95 |
| 4,573,625 | A * | 3/1986 | Olesen et al. | 227/131 |
| 4,705,202 | A * | 11/1987 | Olesen et al. | 227/153 |
| 4,770,334 | A * | 9/1988 | Hoshi et al. | 227/85 |
| 4,978,045 | A * | 12/1990 | Murakami et al. | 227/1 |
| 5,346,114 | A * | 9/1994 | Udagawa et al. | 227/120 |
| 6,923,360 | B2 * | 8/2005 | Sesek et al. | 227/82 |
| 6,986,449 | B2 * | 1/2006 | Straat et al. | 227/87 |

FOREIGN PATENT DOCUMENTS

| | | |
|---|---|---|
| GB | 524649 | 9/1940 |
| GB | 982876 | 2/1965 |
| JP | UM-54-71268 | 5/1979 |
| JP | B-64-011428 | 2/1989 |
| JP | 4275884 | 10/1992 |
| JP | B2-2663800 | 6/1997 |
| JP | A-11-254346 | 9/1999 |
| WO | WO 00/76730 | 12/2000 |

* cited by examiner

*Primary Examiner*—Rinaldi I. Rada
*Assistant Examiner*—Michelle Lopez
(74) *Attorney, Agent, or Firm*—Morgan, Lewis & Bockius LLP

(57) ABSTRACT

A stapler both forms and drivers staples from connected staple blanks retained in a magazine. The stapler includes a driver and a former. The former eliminates jams caused by the last staple in a magazine becoming rotated prior to being formed and struck by having the capability of simultaneously forming a staple being struck and the staple blank connected to the staple being stuck.

9 Claims, 10 Drawing Sheets

PRIOR ART

PRIOR ART

STAPLE FORMING AND DRIVING MACHINE

TECHNICAL FIELD

The present invention relates to a stapler for binding sheets to be bound in which connected staples constituted by aligning a number of staple members in a straight shape to adhere each other are charged into a magazine, the connected staples are successively supplied to a striking portion formed at a front end of the magazine, the connected staples supplied to the striking portion are formed in a C-shape so as to be struck out to the sheets to be bound, and a leg portion of the staple penetrated through the sheets to be bound is folded and bent along a back face of the sheets to be bound.

BACKGROUND ART

There is known a stapler provided with: a magazine formed with a containing portion for containing connected staples and formed with a striking path for striking and guiding a staple at a front end portion thereof; a forming plate opposed to the striking portion of the magazine for forming a staple member in a straight shape into a staple in a C-shape; a forming and striking mechanism comprising a driver plate for striking the staple formed in the C-shape to sheets to be bound, wherein the connected staples are charged to the containing portion of the magazine, the connected staples are supplied to the striking path by a supply mechanism formed at the magazine, forming the staple member at a front of the connected staples by the forming and striking mechanism to be struck out from the striking path to the sheets to be bound and folding to bend a staple leg penetrated through the sheets to be bound by a clincher mechanism arranged on a lower side of the magazine along the back face of the sheets to be bound to thereby bind the staple.

According to the conventional stapler, the driver plate and the forming plate are simultaneously operated at the same timing, the driver plate is arranged in correspondence with the striking path for striking to guide the staple to the sheets to be bound, and the forming plate is arranged to form a staple member frontward from the driver plate by one piece or two pieces of the staples (on a rear side in a direction of feeding the connected staples). (Refer to, for example, JP-B2-2663800) Therefore, when the staple at inside of the striking path is struck by the driver plate, the staple member which is one piece or two pieces short of the struck staple is formed in the C-shape by the forming plate.

When a new staple is charged or when there is carried out an operation of removing a staple jammed in the striking path from the striking path, staples formed above the striking path and a staple guide are removed. Therefore, it is necessary to operate to idly make the stapler strike until a front portion of the connected staples is supplied to a position of the forming plate and a staple member is formed in the C-shape to be supplied to the striking path. By repeatedly carrying out the idle striking operation by a plurality of times, the formed staple is supplied into the striking path and the staple is made to be able to be struck out.

However, there is a case in which a staple binding apparatus included in an apparatus of a copier or the like includes a plurality of pieces of staplers for simultaneously binding a plurality of portions of sheets to be bound. In such an apparatus, when there is carried out the idle striking operation for supplying the formed staple to the striking path after removing jam of a single piece of the stapler, also other stapler is simultaneously operated and the staple is struck out from the other stapler. Therefore, there poses a problem that not only the staple is wastefully consumed but also the struck staple is dropped at inside of the apparatus to cause a failure or the like.

Further, as other conventional art (refer to, for example, JP-B-64-011428), as shown by FIG. 12A and FIG. 12B, there has already been proposed a stapler constituted by a driver plate provided to be opposed to a striking path 30 for striking out and guiding a staple formed in a C-shape, a forming plate 32 formed on two side faces of a driver plate 31 and operated on a plane the same as that of the driver plate 31, and an anvil 33 formed to be able to advance into the striking path 30 for forming a staple member in a straight shape into a C-shape in cooperation with the forming plate 32. According to the stapler, as shown by FIG. 12A and FIG. 12B, the staple member in the straight shape at a front of connected staples is supplied to a recess portion of the anvil 33 advanced into the string path 30, first, the forming plate 32 is driven to form the staple member in the straight shape arranged at inside of the recess portion of the anvil 33 into a C-shape and thereafter, as shown by FIG. 13A and FIG. 13B, the anvil 33 advanced into the striking path 30 is escaped from the striking path 30 by driving the driver plate 31, and the formed staple is struck out from the striking path by the driver plate 31.

According to the stapler, the staple member in the straight shape at the front of the newly charged connected staples is supplied into the striking path 30 by a supply mechanism, the staple member is formed into the C-shape by the initially driven forming plate 32 by operating the stapler and is struck out from the striking path 30 by the driver plate 31 which is driven thereafter. Therefore, it is not necessary to carry out the idly striking operation for supplying the staple formed by the forming plate 32 to the striking path 30 and even in an apparatus mounted with a plurality of pieces of staplers, in the idling striking operation, the staple is not struck out from other stapler.

However, according to the stapler, when the final staple member in the straight shape of the connected staples is supplied to the striking path 30, as shown by FIG. 14, there is a case in which the staple member is rotated at an upper face of the anvil 33 by operation of being pressed by a front portion of the connected staples which are supplied from a rear side. The staple member is normally formed in a shape of an oval shape or the like in which a width dimension and a thickness dimension differ from each other and therefore, when the staple member is rotated, there is a case of bringing about a failure in forming or a failure in staple binding as a result of striking out the staple having the failure in forming. Although in order to prevent the staple member from being toppled, it is possible to increase dimensional accuracy of a supply path of the staple and a containing portion of the staple of the anvil, there poses a problem that fabrication cost is increased in order to highly maintain the accuracy owing to the fact that a ratio of vertical and horizontal dimensions of a section of the staple member is small.

DISCLOSURE OF THE INVENTION

It is a problem of the invention to resolve the problem of the conventional art and provide a stapler in which even when a new cartridge charged with staples is mounted to a magazine, it is not necessary to carry out an idle striking operation and a staple member is not toppled at inside of a striking path.

In order to resolve the above-described problem, a forming and striking mechanism of a stapler of the invention is characterized in being formed with a movable anvil arranged to be able to advance into a striking path at a striking portion formed at a cartridge, the forming and striking mechanism being constituted by a driver plate for striking out a formed staple from the striking path, and a forming plate for forming a plurality of unformed staple members arranged above the movable anvil advanced into the striking path simultaneously in a C-shape, in which after forming the unformed staple member in the C-shape by operating the forming plate, the staple in the striking path is struck out from the striking path by operating the driver plate on a plane the same as that of the forming plate.

Further, there may be constructed a constitution in which the striking portion formed at the cartridge is formed with a fixed anvil formed at a front end portion of the staple guide for guiding connected staples to the striking portion, and a movable anvil arranged to be able to advance into the striking path to be opposed to the fixed anvil, the forming and striking mechanism is constituted by a driver plate for striking out a formed staple at the striking path from the striking path, and the forming plate for forming the plurality of unformed staples arranged above the fixed anvil formed at the movable anvil advanced into the striking path and a front end of the staple guide simultaneously in the C-shape, and after forming the unformed staple member in the C-shape by operating the forming plate, the staple at inside of the striking path is struck out from the striking path by operating the driver plate on the same plane.

According to the staple of the invention, the unformed staple member at the front of the connected staples is supplied to above the movable anvil advanced into the striking path, the staple member arranged above the striking path is formed in the C-shape by operating the forming plate, at the same time, the staple member successive to the front staple is simultaneously formed into the C-shape, thereafter, the staple formed above the striking path is struck out from the striking path by the driver plate while escaping the movable anvil from above the striking path and therefore, it is not necessary to carry out the idle striking operation for supplying the formed staple into the striking path when a new one of the cartridge is mounted, or when the cartridge operated to remove a jammed staple is mounted and the staples can be prevented from being wastefully consumed in an apparatus mounted with a plurality of pieces of staplers.

Further, when a staple at second from a final one of a series of the connected staples formed in the sheet-like shape is struck out from the striking path by the driver plate, the final staple of the connected staples has already been formed in the C-shape by the forming plate and therefore, the staple is not toppled when the staple is supplied into the striking path by being pressed by a successive one of the connected staples and staple jamming or the like can be prevented from being brought about.

Figure 1:
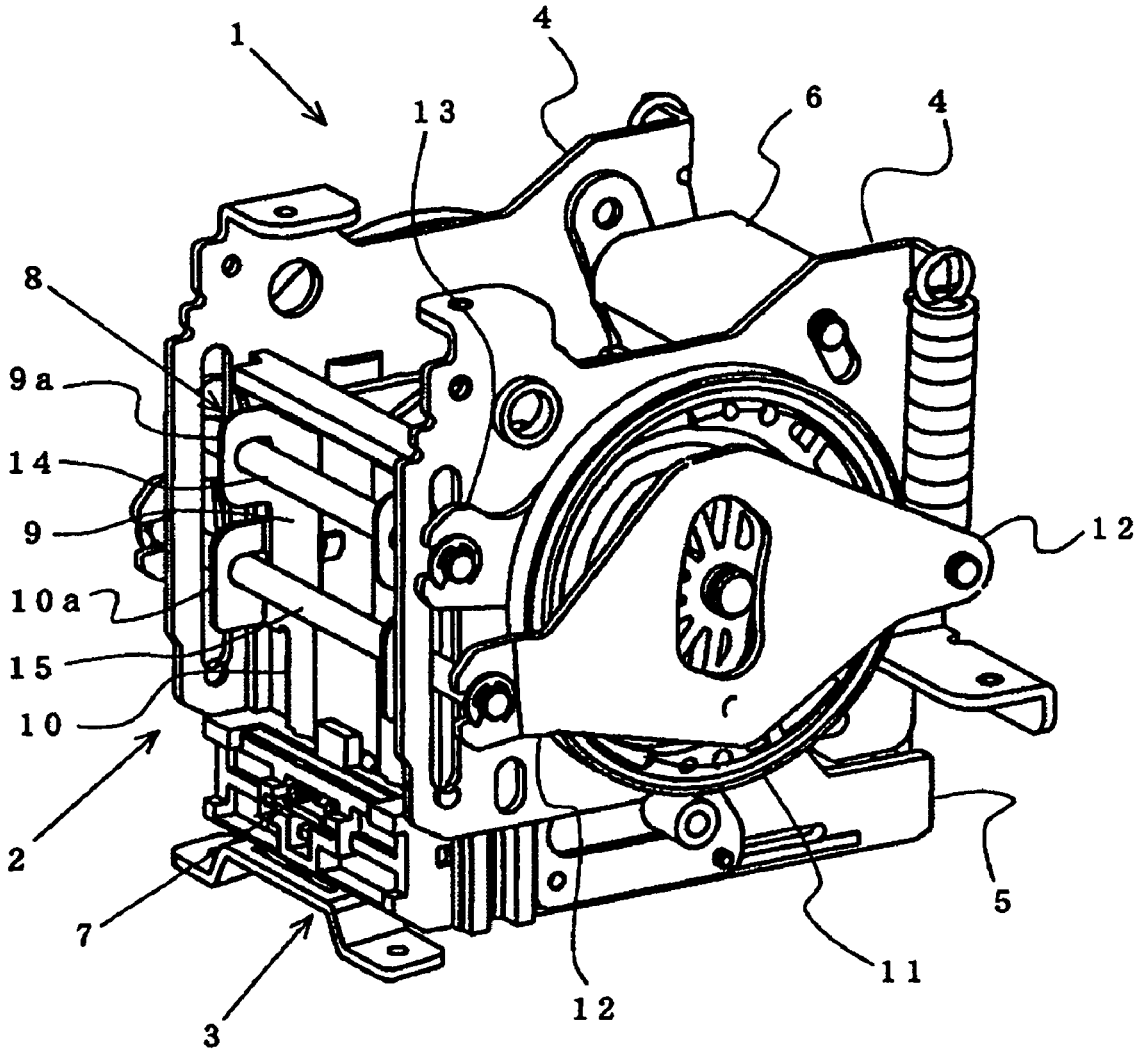
FIG. 1 is a perspective view showing a stapler according to an embodiment of the invention.

Further, in notations in the drawings, numeral 1 designates a stapler, numeral 8 designates a forming and striking mechanism, numeral 16 designates a staple guide, numeral 17 designates a fixed anvil, numeral 18 designates a striking path, numeral 19 designates a movable anvil, numeral 20 designates a recess portion, numeral 21 designates an inclined face.

BEST MODE FOR CARRYING OUT THE INVENTION

FIG. 1 is a perspective view showing a stapler embodying a staple supply mechanism of the invention. The stapler 1 is arranged at a path of carrying a sheet at inside of a copier, a printer or the like. A staple driving portion 2 for striking out a staple to sheets to be bound is arranged on one side interposing the path of carrying the sheet, and an opposite side of the carrying path is arranged with a clincher portion 3 for folding to bend a staple leg penetrated through the sheets along a back face of the sheets to be bound to bind a plurality of sheets to be bound processed to be copied or printed. Connected staples used in the stapler 1 are formed in a sheet-like shape by aligning in parallel a predetermined number of pieces of the staple members in a straight shape and connecting contiguous ones of the staple members by an adhering agent or the like. A cartridge charged with the connected staples is mounted to a magazine to successively supply to a striking portion formed at the magazine, the staple member in the straight shape at a front portion of the connected staples is formed into the staple in a C-shape and the staple formed in the C-shape is struck out to the sheets to be bound.

The staple driving portion 2 is constituted by a pair of support frames 4 formed on one side of the path of carrying the sheets to be bound, the magazine 5 slidably supported to the sheets arranged at a carrying path between the pair of support frame 4, and the cartridge 6 charged with the connected staples in the sheet-like shape mounted to inside of the magazine 5. The cartridge 6 mounted to the magazine 5 is formed with a staple guide for guiding the connected staples. A front end portion of the staple guide is formed with an anvil for forming the staple member in the straight shape at the front portion of the connected staples in the C-shape, and a striking portion 7 forming a striking path for striking out and guiding the staple formed in the C-shape to the sheets to be bound. The magazine 5 is formed with a staple supply mechanism for supplying the connected staples charged to the cartridge 6 to the striking portion 7, and the forming and striking mechanism 8 for forming the staple member in the straight shape supplied to the striking portion in the C-shape and striking out the staple formed in the C-shape from the striking path to the sheets to be bound.

The forming and striking mechanism 8 is constituted by a driver plate 9 held by the magazine 5 to be able to be operated slidably at inside of the striking path to be opposed to the striking path formed at the striking portion 7 of the cartridge 6, and a forming plate 10 opposed to an anvil of the striking portion 7 and slidably held thereby. Drive rotating members 11 driven to rotate by an electric motor, not illustrated, are rotatably supported by outer side faces of the two support frames 4. The respective outer side faces of the drive rotating members 11 are arranged with forming links 12 engaged with forming cams formed at the drive rotating members 11. The forming plate 10 is driven by way of the forming links 12 operated to be rocked by rotating the drive rotating members 11. Further, respective inner side faces of the drive rotating members 11 are arranged with driver links 13 engaged with driver cams formed at the drive rotating members 11. The driver plate is driven by way of the driver links 13 operated to be rocked by the drive rotating members 11. Both ends of operating shafts 14, 15 connected to the driver plate 9 and the forming plate 10 are connected to ends on one side of the driver links 13 and the forming links 12 and the driver plate 9 and the forming plate 10 are respectively operated by cam grooves formed at the drive rotating members 11 independently from each other by way of the driver links 13 and the forming links 12 operated by rotating the drive rotating members 11.

Figure 2:
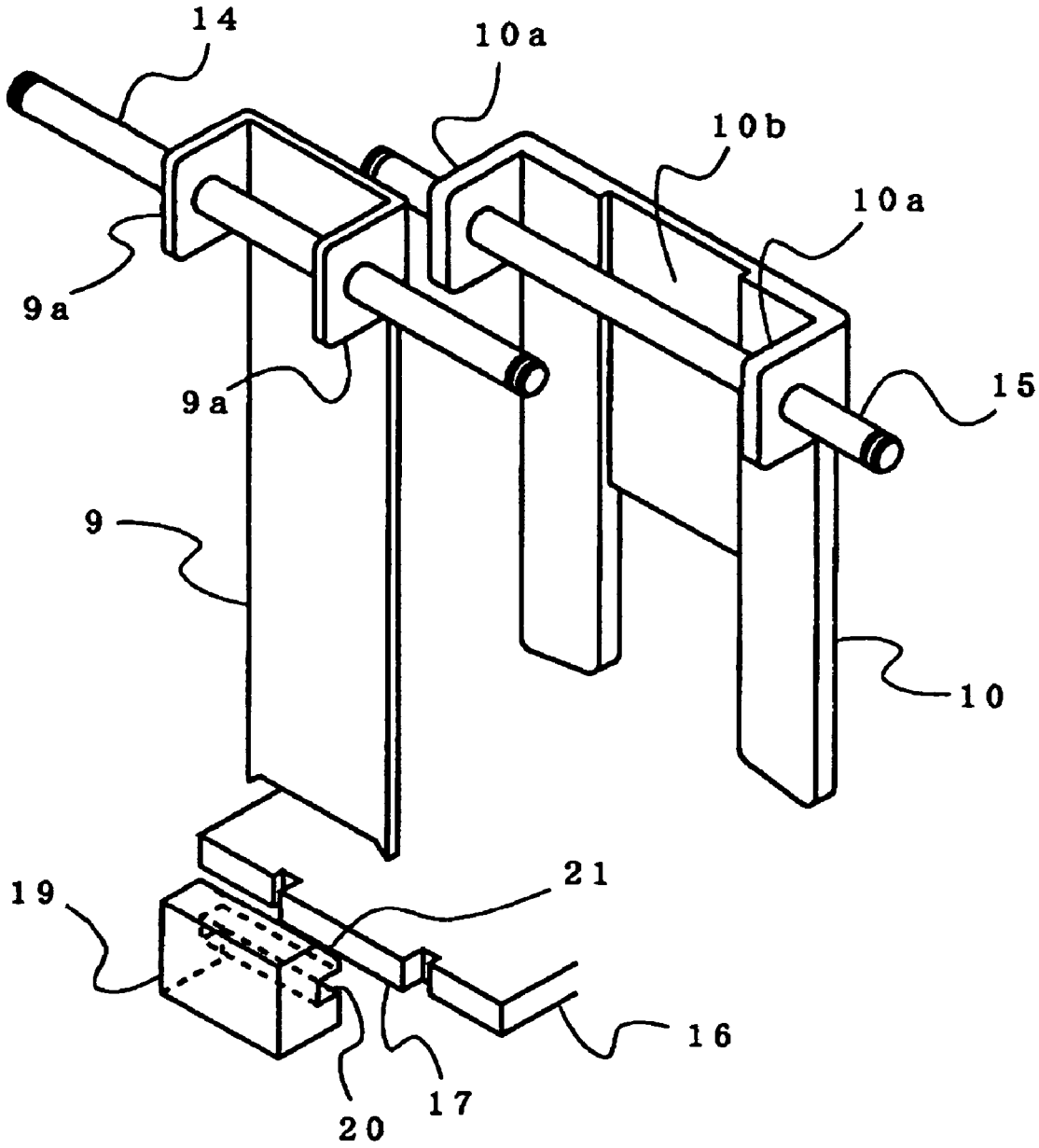
FIG. 2 is a disassembled perspective view of the stapler.
Figure 3:
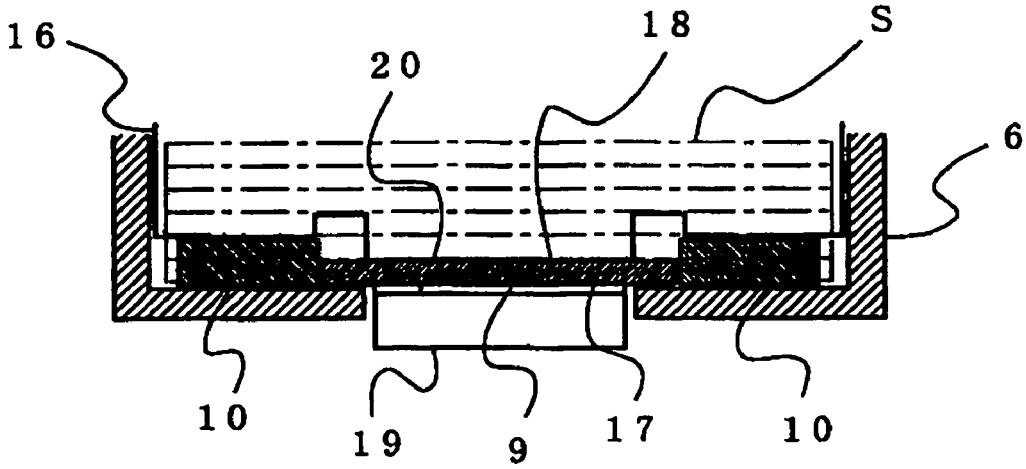
FIG. 3 is across-sectional plane view of a striking portion of the stapler and a forming and striking mechanism.

As shown by FIG. 2 and FIG. 3, the driver plate 9 is formed by a plate member having a thickness substantially the same as a width dimension of a section of the staple member and both side edges of an upper end portion thereof are integrally formed with flange portions 9*a* which are formed by being folded to bend to direct to a front side. Both ends of the operating shaft 14 penetrated to insert to the flange portions 9*a* are connected to ends on one side of the driver links 13 and driven by operating the driver links 13. The forming plate 10 is formed by a plate member having a thickness of an amount of two pieces of the width dimension of the section of the staple member such that a plurality of pieces of the staple members contiguous to each other of the connected staples can simultaneously be formed in the C-shape, and the operating shaft 15 penetrated to insert to flange portions 10*a* formed at an upper end thereof are connected to ends on one side of the forming links 12 and driven by operating the forming links 12. A center of a face directed to the front side of the forming plate 10 is formed with a recess portion 10*b* for containing the driver plate 9, thereby, a portion of the forming plate 10 is arranged on a plane the same as that of the driver plate 9.

The fixed anvil 17 formed at a front end of the staple guide 16 for guiding the connected staples to the striking portion is arranged to face the striking path 18 at which the driver plate 9 is slidingly moved, and the staple member of the connected staples supplied along the staple guide 16 and arranged above the fixed anvil 17 is made to be formed into the staple in the C-shape by operating the forming plate 10. Further, there is arranged the movable anvil 19 capable of advancing into the striking path 18 from a front side of the striking path 18 to be opposed to the fixed anvil 16. The movable anvil 19 is formed with the recess portion 20 opened to a rear side and an unformed one of the front of the connected staples is made to be able to be received into the recess portion 20. The movable anvil 19 is urged by a spring or the like, not illustrated, to advance into the striking path 18 from the front side of the striking path 18. When the cartridge 6 which is not used yet is mounted, or when the cartridge 6 which has removed the jammed staple is mounted, the staple member at the front of the connected staples supplied along the staple guide 16 is contained at inside of the recess portion 20 of the movable anvil 19 and the staple member is formed into the C-shape by operating the forming plate 10.

An upper face of the movable anvil 19 is formed with the inclined face 21 engaged with a lower end of the driver plate 9, when the driver plate 9 is operated after operating the forming plate 10, the lower end of the driver plate 9 is engaged with the inclined face 21 to escape the movable anvil 19 from inside of the striking path 18 against a spring urge force and the staple formed into the C-shape is struck out from the striking path 18 by the driver plate 9. The width dimension of the movable anvil 19 is formed by a dimension smaller than the width dimension of the fixed anvil 17 to be able to supply the staple formed by the fixed anvil 17 smoothly onto the movable anvil 19 when the staple is supplied to the movable anvil 19 and to draw out the movable anvil 19 easily from between legs of the staple formed in the C-shape to escape from the striking path 18 when the inclined face 21 of the movable anvil 19 is engaged with the driver plate 9.

Figure 4:
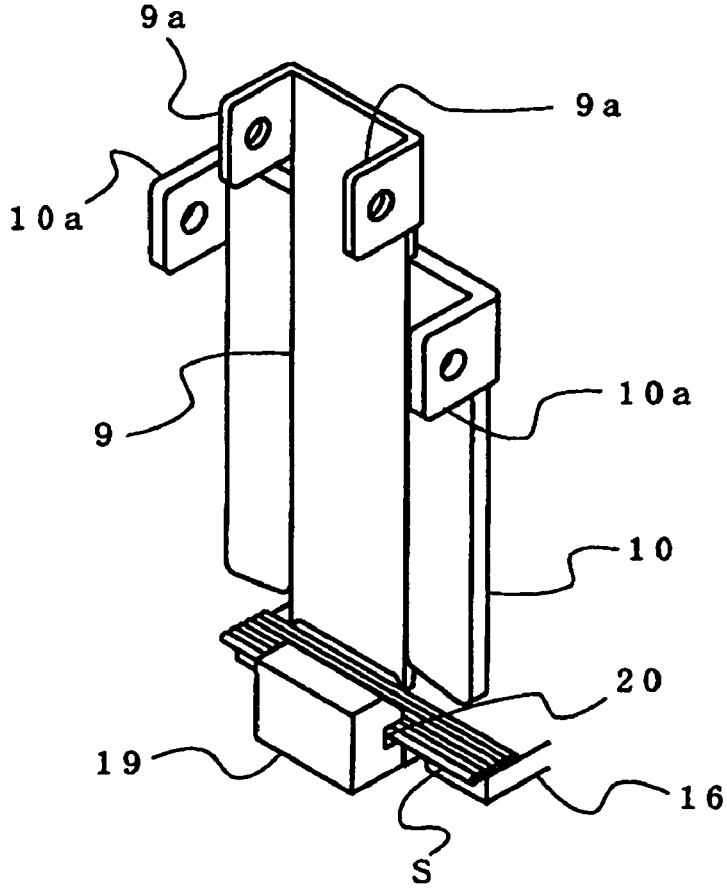
FIG. 4 is a perspective view of the striking portion and the forming and striking mechanism in an unoperated state.
Figure 5A:
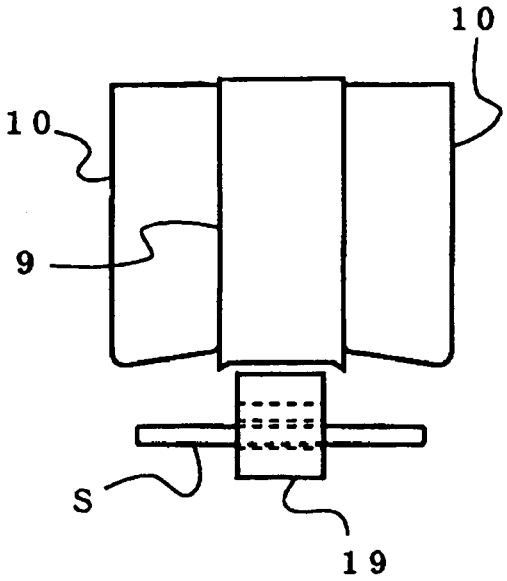
FIG. 5A is a front view of the striking portion and the forming and striking mechanism in a state the same as that of FIG. 4.
Figure 5B:
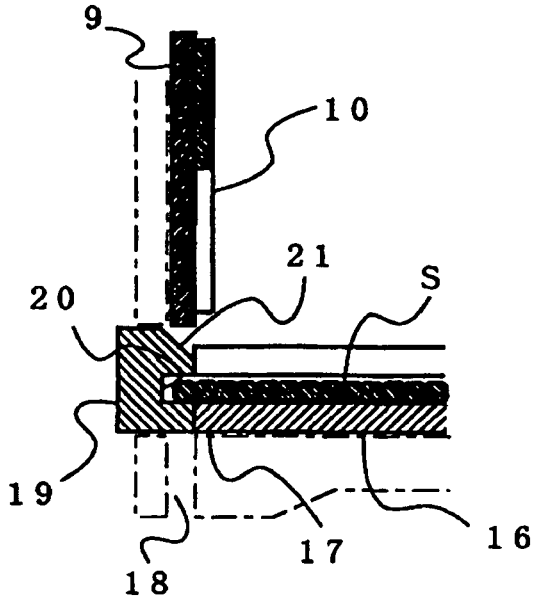
FIG. 5B is a vertical sectional side view of the striking portion and the forming and striking mechanism in the state the same as that of FIG. 4.

As shown by FIG. 4, FIG. 5A and FIG. 5B, in a state in which the stapler 1 is not operated, both of the driver plate 9 and the forming plate 10 are arranged at upper standby positions and the movable anvil 19 is made to advance into the striking path 18 by the spring urge force to be arranged to be opposed to the fixed anvil 17. When sheets to be bound are arranged between the clincher portion 3 and the staple driving portion 2 and the stapler 1 is driven, the magazine 5 is operated in a direction of the clincher portion 3 by rotating the drive rotating members 11 to clamp the sheets to be bound between the magazine 5 and the clincher portion 3. In accordance with the operation of the magazine 5, the staple supply mechanism is driven, and the connected staples S are supplied until the staple member at the front of the connected staples S charged to the cartridge 6 is arranged at inside of the recess portion 20 formed at the movable anvil 19 advanced into the striking path 18.

Figure 6:
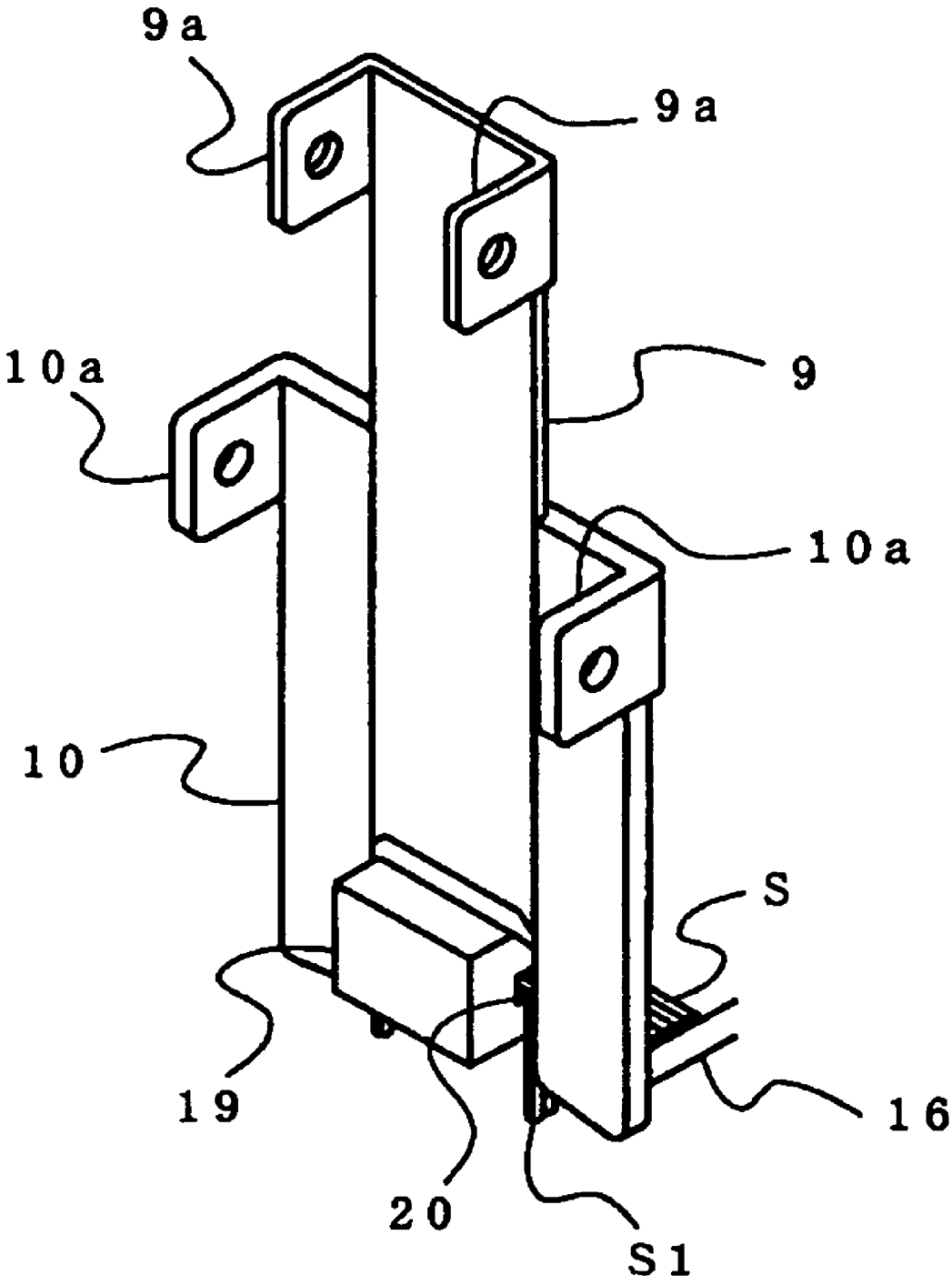
FIG. 6 is a perspective view showing the striking portion and the forming and striking mechanism in a state of operating a forming plate.
Figure 7A:
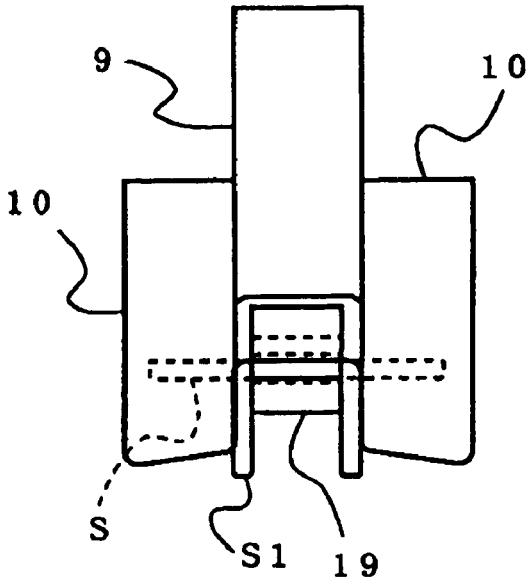
FIG. 7A is a front view of the striking portion and the forming and striking mechanism in a state the same as that of FIG. 6.
Figure 7B:
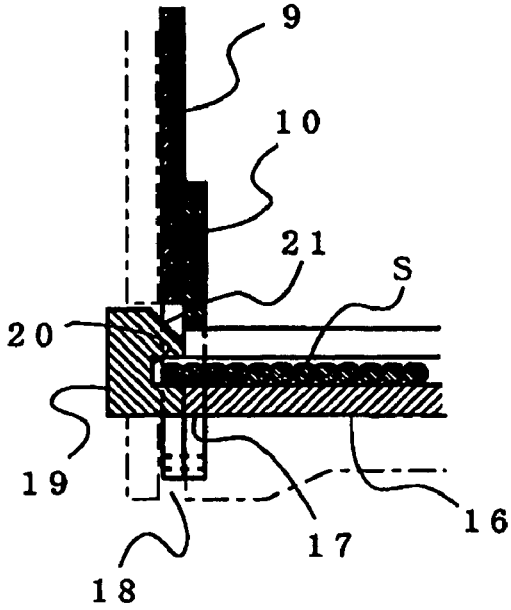
FIG. 7B is a vertical sectional side view of the striking portion and the forming and striking mechanism in the state the same as that of FIG. 6.

Next, as shown by FIG. 6, FIG. 7A and FIG. 7B, by rotating the drive rotating members 11, the forming plate 10 is driven in a lower direction by way of the forming links 12, and the staple member arranged at inside of the recess portion 20 of the movable anvil 19 is formed into the C-shape. At this occasion, the forming plate 10 is formed by the thickness of the amount of two pieces of the staples and therefore, a next staple member successive to the staple member at the front arranged on the fixed anvil 17 is formed into the staple S1 by the forming plate 10 simultaneously with the staple member of the front.

Figure 8:
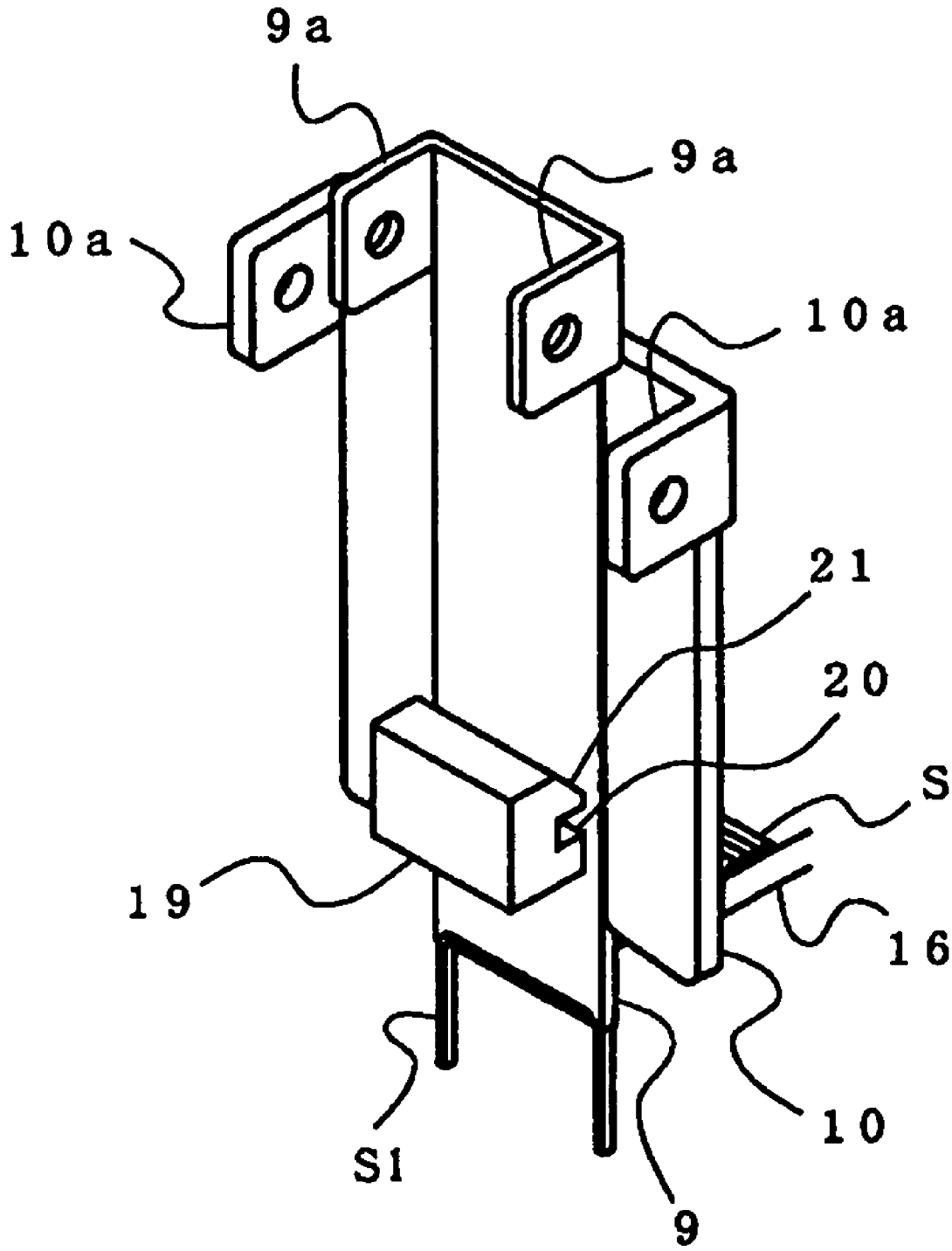
FIG. 8 is a perspective view showing the striking portion and the forming and striking mechanism in a state of operating a driver plate.
Figure 9A:
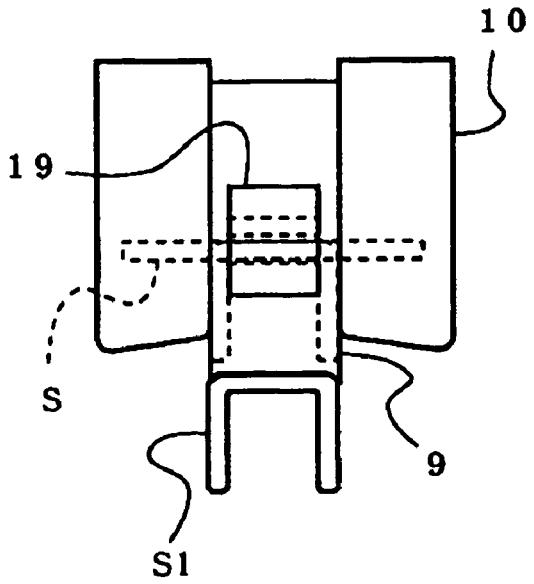
FIG. 9A is a front view of the striking portion and the forming and striking mechanism in a state the same as that of FIG. 8.
Figure 9B:
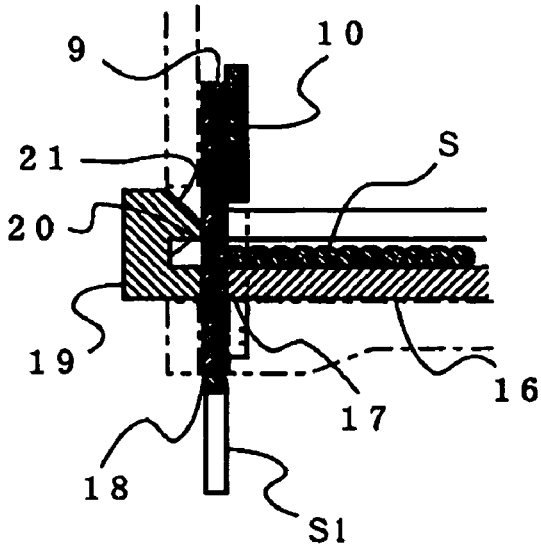
FIG. 9B is a vertical sectional side view of the striking portion and the forming and striking mechanism in the state the same as that of FIG. 8.

Thereafter, as shown by FIG. 8, FIG. 9A and FIG. 9B, by rotating the drive rotating members 11, the driver plate 9 is driven in the lower direction by way of the driver links 13, the lower end of the driver plate 9 is engaged with the inclined face 21 formed at the upper face of the movable anvil 19 which has advanced into the striking path 18 to move the movable anvil 19 to the front side of the striking path 18 to escape from the striking path 18. After escaping the movable anvil 19 from the striking path 18, the driver plate 10 is further operated in the lower direction to strike out the staple S1 at the front formed in the C-shape from the striking path 18 to the sheets to be bound clamped on the side of the lower face of the magazine 5. Further, the legs of the staple S1 penetrated through the sheets to be bound are folded to bend along the back face of the sheets to be bound by the clincher 3 to finish to be bound by the staple.

After finishing to bind sheets by the staple, when the driver plate 9 and the forming plate 10 are returned to the upper standby positions, the movable anvil 19 advances into the striking path 18 again by the spring urge force and arranged to be opposed to the fixed anvil 17. At a successive staple binding operation, the staple S1 formed in the C-shape above the fixed anvil 17 by the staple binding operation at a preceding time is supplied into the striking path 18 by operating to supply the connected staples S1 and a new one of the staple member is arranged on the fixed anvil 17 continuously to the staple S1. Further, in the successive staple binding operation, by driving the forming plate 10, only the staple member arranged above the fixed anvil 17 is formed into the C-shape, and the driver plate 9 strikes out the staple S1 formed in the staple binding operation at the preceding time from the striking path 18.

Figure 10:
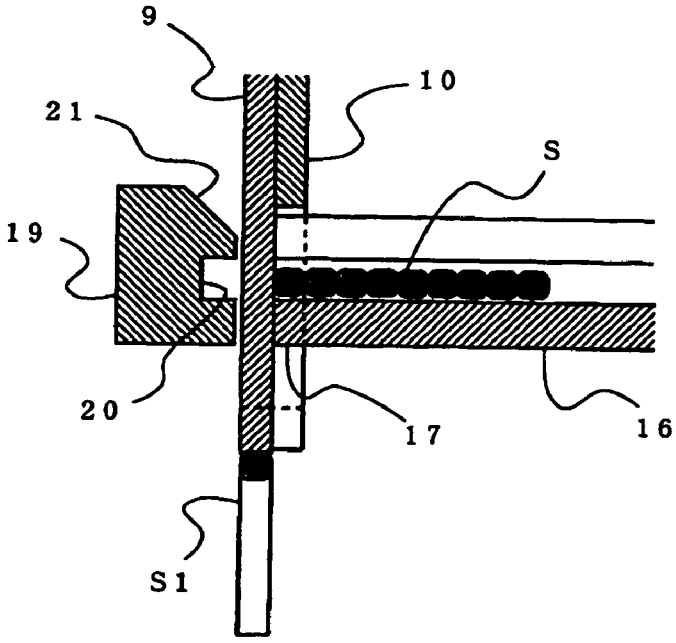
FIG. 10 is a vertical sectional side view in a state of striking out a staple second frontward from a final one of connected staples.
Figure 11:
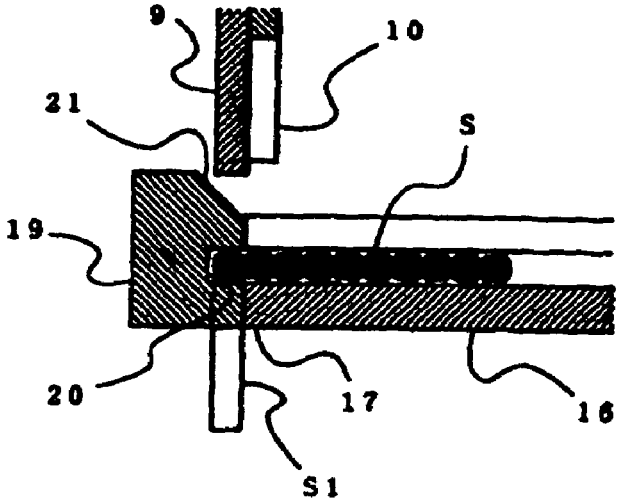
FIG. 11 is a vertical sectional side view of a state of supplying a final staple of the connected staples to a striking path.
Figure 12A:
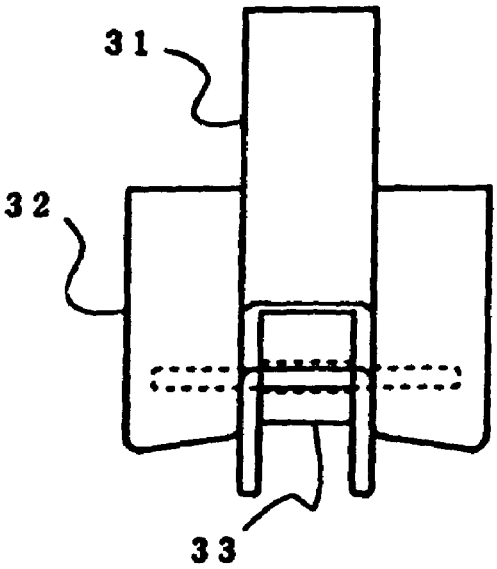
FIG. 12A is a front view showing a striking portion of a background art in a state of operating a forming plate.
Figure 12B:
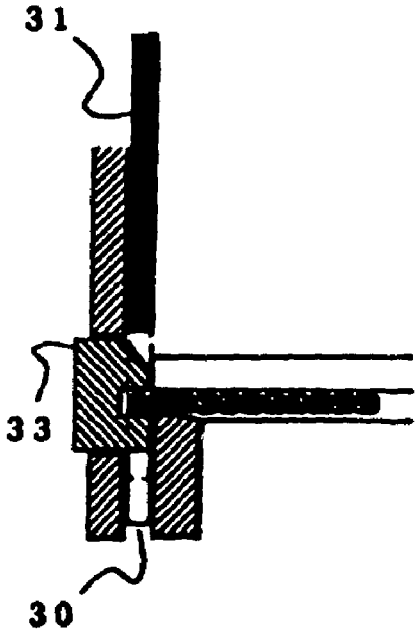
PRIOR ART FIG. 12B
FIG. 12B is a vertical sectional side view showing the striking portion of the background art in the state of operating the forming plate.
Figure 13A:
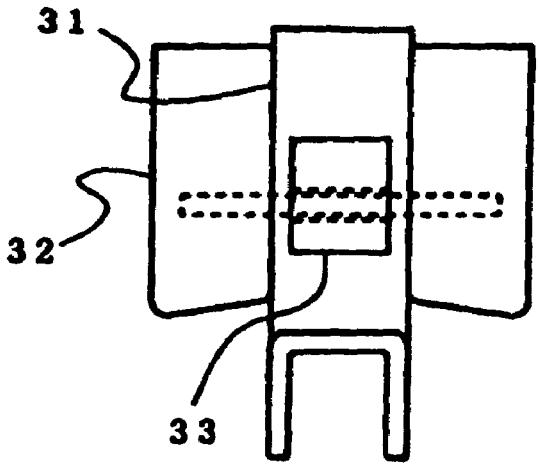
FIG. 13A is a front view showing the striking portion of the background art in a state of operating a driver plate.
Figure 13B:
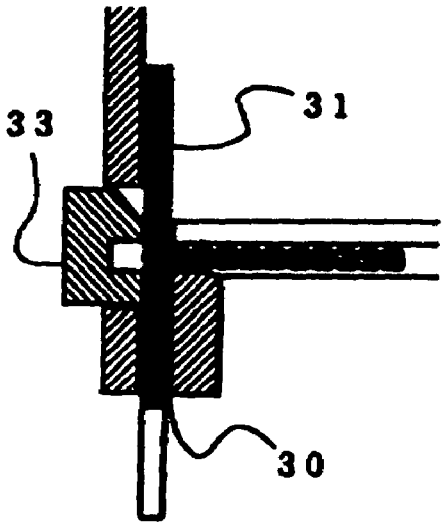
PRIOR ART FIG. 13B
FIG. 13B is a vertical sectional side view showing the striking portion of the background art in the state of operating the driver plate.
Figure 14:
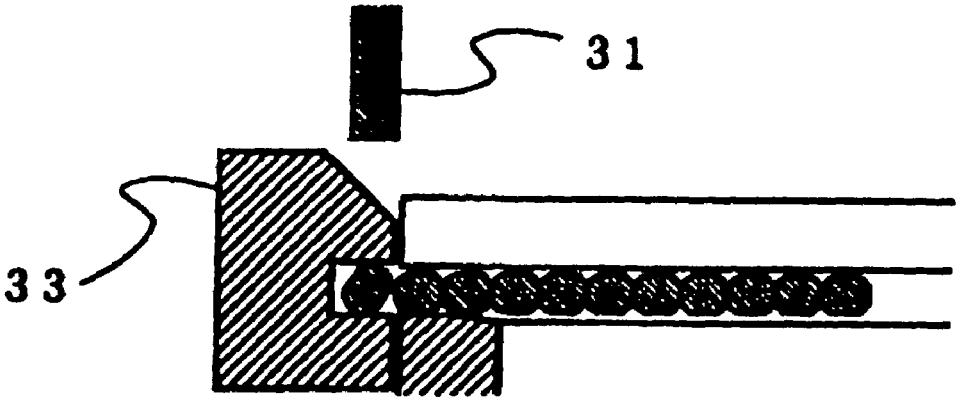
PRIOR ART FIG. 14
FIG. 14 is a vertical sectional side view showing the striking portion of the background art in a state of supplying a staple member at a final end to a striking path.

As shown by FIG. 10, when the staple S1 second from the rear end of the connected staples S connected in the sheet-like shape is struck out by the driver plate 9, the final staple S1 of the connected staples has been formed in the C-shape by the forming plate 10, the staple binding is finished and the driver plate 9 and the forming plate 10 are returned to the upper standby positions as shown by FIG. 11, the movable anvil 19 advances into the striking path 18 and thereafter, the final staple S1 of the connected staples is pressed by a succeeding one of the connected staples S supplied above the staple guide 16 and is supplied into the striking path 18. The final staple S1 has already been formed in the C-shape and therefore, the final staple S1 is not toppled at inside of the striking path 18 and can firmly be struck out from the striking path 18 by the driver plate 9 by the successive staple binding operation and a failure in forming or a failure in binding sheets by the staple is not brought about.

INDUSTRIAL APPLICABILITY

The stapler of the invention is applicable also to a stapler included in a post processing apparatus for classifying sheets discharged from an apparatus of a copier, a facsimile or the like for binding sheets classified by the apparatus, or a stapler of a type which is not included in the apparatus and used on a table by itself other than the stapler arranged along the path of carrying sheets at inside of a copier or the like described in the embodiment for binding sheets carried along the carrying path. Further, the invention is not limited to the stapler using the connected staples formed in the sheet-like shape described in the embodiment but is applicable to a stapler in which connected staples are formed into connected staples wound with long connected staples in a scroll-like shape and is charged into a magazine.

According to the stapler of the invention, the staple member on the striking path and the staple member successive thereto are simultaneously formed by the forming plate and therefore, there is dispensed with idle operation for supplying a formed staple to a striking path when a new staple is charged or after removing a jammed staple in the striking path, further, the staple member supplied to the striking portion is prevented from being toppled.

The invention claimed is:

1. A stapler comprising:

a cartridge, wherein connected staples constituted by aligning and connecting a number of staple members in a straight shape are charged in the cartridge;

a striking portion formed with a striking path at a front end portion thereof;

a magazine, wherein the cartridge is mounted in the magazine;

a staple supply mechanism formed in the magazine for supplying the connected staples of the cartridge to the striking portion;

a forming plate that forms the staple member supplied to the striking portion in a C-shape;

a driver plate slidable in the striking path;

a clincher mechanism that folds and bends a leg of the staple member penetrated through sheets to be bound along a back face of the sheets to be bound;

a movable anvil capable of advancing into the striking path;

a staple guide that guides the connected staples to the striking portion; and a fixed anvil formed at a front end portion of the staple guide, wherein the fixed anvil protrudes into a plane in which the forming plate moves up and down, wherein the forming plate is capable of forming the staple member which is arranged above a portion of the movable anvil advanced into the striking path and the staple member which is successive to the staple member above the fixed anvil simultaneously in the C-shape; and the driver plate strikes out the formed staple in the striking path from the striking path after the forming plate is operated.

2. The stapler according to claim 1, wherein the driver plate and the forming plate are operated on the same plate.

3. The stapler according to claim 1, wherein the forming plate is formed by a plate member having a thickness by an amount of substantially two pieces of a width dimension of a section of the staple member; and the driver plate is formed by a plate member having a thickness the same as the width dimension of the section of the staple member.

4. The stapler according to claim 1, wherein the striking portion is formed at the cartridge.

5. The stapler according to claim 1, wherein the forming plate is capable of simultaneously forming the staple member which is arranged above a portion of above the movable anvil advanced into the striking path and a staple member which is arranged on the fixed anvil.

6. The stapler according to claim 5, wherein the staple member which is successive to the staple member above a portion of the movable anvil is formed in the C-shape on the fixed anvil.

7. The stapler according to claim 1, further comprising a recess portion formed on the forming plate at a face directing to the movable anvil, wherein the driver plate is contained in the recess portion.

8. The stapler according to claim 1, wherein a width of the movable anvil is smaller than a width of the fixed anvil.

9. A stapler comprising:

a cartridge, wherein connected staples constituted by aligning and connecting a number of staple members in a straight shape are charged in the cartridge;

a striking portion formed with a striking path at a front end portion thereof;

a magazine, wherein the cartridge is mounted in the magazine;

a staple supply mechanism formed in the magazine for supplying the connected staples of the cartridge to the striking portion;

a forming plate having a first leg and a second leg, and also having a first and second position;

a driver plate slidable in the striking path;

clincher mechanism;

a movable anvil;

a staple guide that guides the connected staples to the striking portion; and a fixed anvil, wherein when the forming plate is in the second position, a first leg of a staple arranged above the movable anvil advanced into the striking path is located between the first leg of the forming plate and the movable anvil, and when the forming plate is in the second position, a first leg of any staple directly connected to the staple arranged above a portion of the movable anvil advanced into the striking path is located between the first leg of the forming plate and the fixed anvil.

* * * * *